US005472337A

United States Patent [19]

Guerra

[11] Patent Number: 5,472,337

[45] Date of Patent: Dec. 5, 1995

[54] METHOD AND APPARATUS TO DETECT A FLAME

[76] Inventor: Romeo E. Guerra, 6118 Walnut La., Dallas, Tex. 75230

[21] Appl. No.: 304,681

[22] Filed: Sep. 12, 1994

[51] Int. Cl.[6] ..... F23N 5/00

[52] U.S. Cl. ..... 431/78; 431/25; 340/579

[58] Field of Search ..... 431/25, 78; 340/579

[56] References Cited

U.S. PATENT DOCUMENTS

| | | | |
|---|---|---|---|
| 3,302,685 | 2/1967 | Ono et al. | 340/579 |
| 3,875,476 | 4/1975 | Crandall et al. | 431/258 |
| 4,672,324 | 6/1987 | Kampen | 431/25 |
| 5,049,063 | 9/1991 | Kishida et al. | 431/25 |
| 5,073,104 | 12/1991 | Kemio | 431/25 |

*Primary Examiner*—Carroll B. Dority
*Attorney, Agent, or Firm*—Sankey & Luck

[57] ABSTRACT

An apparatus and method to qualify the condition of a flame body is disclosed, where such apparatus comprises a power source, an amplifier and sensor means, where said sensor means includes two or more probes disposed in spaced apart relation so as to conduct a current and said amplifier is designed to selectively amplify the signal generated between said probes so as to isolate a selected frequency consistent with ionization of a given fuel/air mixture.

24 Claims, 3 Drawing Sheets

METHOD AND APPARATUS TO DETECT A FLAME

BACKGROUND OF THE INVENTION

1. Field of the Invention

The present invention generally relates to a method and apparatus to detect the presence, absence, intensity and/or stability of a flame. More specifically, the present invention is directed to a novel method and apparatus which utilizes the modulating impedance within a given flame envelope generated as a result of the combustion process.

2. Description of the Prior Art

In a variety of industrial and other applications it is imperative to continuously evaluate and immediately identify the presence of, absence of, and/or the quality of a flame. Such applications include, for example, the burner flame within an enclosed vessel arrangement. If combustible gases are continued to be fed to such a vessel after the burner flame has been extinguished, a subsequent accidental spark may ignite these same gases thereby producing a catastrophic explosion. Similarly, in an open flare stack application it is also necessary to continuously monitor the flare pilots which ignite and burn vented gases. If the flare pilot is somehow extinguished during operation, noxious and/or combustible gases emanating from the stack, often heavier than air, will collect around the base of the stack thereby creating a risk and jeopardy to human life in conjunction with the attendant risk of fire or explosion.

A third example is seen in jet engines, and especially high performance military variants of jet engines, where "flare outs" sometimes occur thereby depriving the plane of significant operator control. In such instances, it is imperative that the absence of an ignitor flame be identified at an early stage so that remedial measures may be taken.

A number of devices have been developed to identify the presence or absence of a flame in response to the above and other situations. One of the more common of such devices is a flame detector often used in the ignitor of a flare stack which evaluates the direct current resistance of a flame as measured between two conductive, electrically isolated probes. This method of flame detection, commonly known as flame ionization detection, depends heavily on adequate electrical isolators between the probes for an accurate reading. In such devices, the presence of a selected conductivity to a direct current, usually in the range of 20–40 megohms, between the two probes is interpreted as indicating the presence of a flame.

Disadvantages with such systems reside in false or "ghost" signals created by contaminants and moisture which are often present in the burner chamber. When the electrical isolators which separate the probes become contaminated by moisture and dirt, their outer surface becomes conductive, thereby compromising the reading and rendering a false flame indication. The difficulty with flame ionization detection systems are thus compounded since the false signal is generated when the system remains in an "on" mode. This is colloquially referred to as a "non fail safe" condition.

A variety of other solutions to the difficulties and problems of flame detection have been proposed in the art. One such proposal is that for a remote sensor such as that disclosed in U.S. Pat. No. 3,586,468 as issued to Sims which discloses the use of an electromagnetic antenna provided in the vicinity of the flame. Flames are known to naturally generate electromagnetic waves which, according to Sims, are picked up by the antenna. Sims provides an ultrasonic signal to the burner to artificially produce variations in the flame at a characteristic frequency to aid in flame detection.

Other proposed solutions include the evaluation of different compression—rarefaction wave frequencies as disclosed in U.S. Pat. No. 3,233,650 as issued to Cleall or the evaluation of the acoustics of the burner chamber as disclosed in U.S. Pat. No. 2,767,783 as issued to Rowel et al. Disadvantages of these and similar techniques include, in the case of an acoustic detector, the difficulty of identifying a universally accurate and useful relationship between the acoustics of a given burner and the sound intensity created by the combustion of a given fuel/air mixture. Accordingly, the use of an acoustic apparatus often presents difficulty in retrofitting a burner already in operation.

SUMMARY OF THE INVENTION

The present invention relates to a new and novel flame detection and evaluation system and method for its operation which utilizes the modulating impedance within the flame plasma generated as a result of the numerous chemical reactions occurring during the combustion process. While the present invention has particular application to the detection of a flame within a flare pilot, the present invention also has utility to various other applications where it is necessary to accurately evaluate the presence, absence and/or quality of a flame.

In one embodiment, the present invention includes a sensor means; e.g., a probe, which is situated in or proximate to the flame envelope, means to selectively amplify alternating current cycled between the sensor means and a second probe, and means to differentiate and interpret the resultant signal. In a preferred embodiment, an amplifier is used to detect an alternating current of a selected frequency through a circuit which includes both the first and second probes. This signal is filtered and then compared against signals known to be derived from the ionization of the gas mixture employed in the particular flame. From this comparison, a decision can be made as to the existence, absence or quality of a flame, and appropriate action taken.

By utilizing one or more conductive probes, and by locating these probes at strategic locations adjacent to or within the flame plasma, and by employing an amplifier at each probe which is amplitude and frequency selective, the variations in the plasma impedance result in a unique electrical signal that is representative of the flame quality. Because the amplifiers are frequency and amplitude selective, only the desired signal will be processed through these amplifiers to indicate a flame. This method of flame detection and flame quality recognition will not erroneously indicate the presence of a flame.

The present invention offers a number of advantages over the prior art. One such advantage is the avoidance of erroneous signals such as those prevalent in direct current systems as induced by humidity or contamination. In this connection, the utilization of alternating current by the present system renders it substantially unaffected by rigorous operating conditions where water and contamination is present. Moreover, events which would serve to present an erroneous signal, e.g. a short, or an open in the probe circuit, serve to obviously disable the apparatus and thus do not present a "non fail safe" condition.

Another advantage of the present invention is the significant enhancement of service life. The sensory means of the present invention need not be positioned directly in the high temperature areas of the flame but may instead be positioned in the much lower temperature peripheral flame zones. Accordingly, deterioration associated with continuous and prolonged heating of the sensory apparatus and other related components may be avoided. Yet another advantage of the invention include instantaneous signal input which results in more ready detection of the flame status.

Yet other benefits and advantages of the present invention may be seen by reference to the drawings and the subsequent description of the preferred embodiments.

DETAILED DESCRIPTION OF THE PREFERRED EMBODIMENTS

Figure 1:
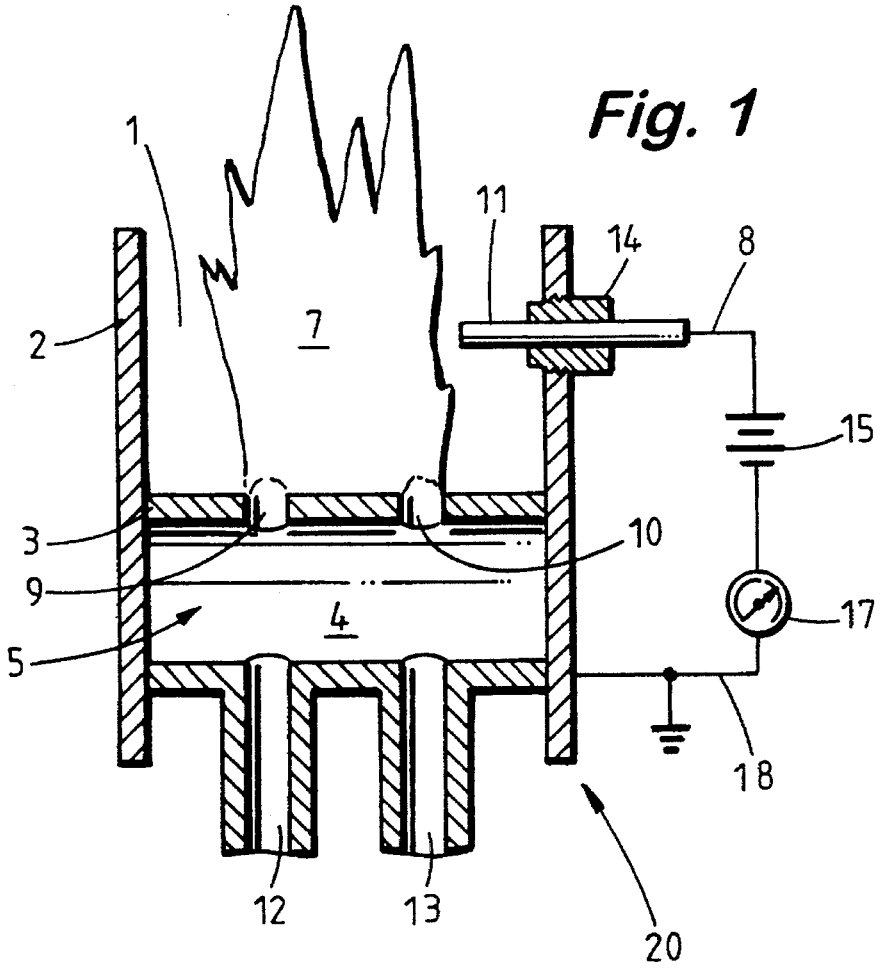
FIG. 1 schematically illustrates a conventional direct current flame detector as it may be applied to a flare pilot.

FIG. 1 schematically illustrates a prior art flame detector 20, generally known in the industry as an ionization flame detector, as incorporated within a conventional pilot chamber 1 as defined by containment walls 2 and base 3. A mixture chamber 5 is disposed immediately below chamber 1 and functions to combine combustible fuels 4 introduced through apertures 12 and 13 or other conventional arrangement. This combined combustible mixture is then introduced into pilot chamber 1 via apertures 9 and 10 as a source for flame 7. The detector 20 itself is generally comprised of a conductive probe 11, a suitable electrical isolator 14, a conductive wire 8, a direct current electrical current source 15, an indicator gauge 17 and a return path such as a ground 18.

The aforedescribed system monitors the electrical conductivity of the ionization of the flame between the probe 11 and ground 18. Conventional direct current flame detection systems generally evaluate resistances between 20–40 megohms where the presence of resistances in this range is construed as indicating the presence of a flame in flame chamber 1. As noted above, however, residue and moisture collecting on electrical isolator 14 frequently can create readings well below the 20–40 megohms range which may mimic the resistance created by a flame, thereby presenting a false indication that a flame is present.

Figure 5:
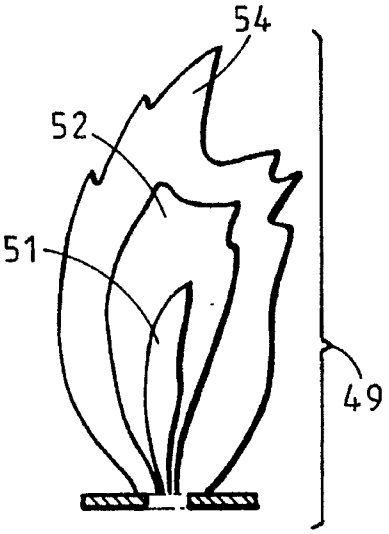
FIG. 5 illustrates a cross section of the various regions of a flame body.

By reference to FIG. 5, a conventional flame is comprised of a plurality of zones where each zone maintains a discrete temperature and color when compared with the rest of the flame body 49. For purposes of discussion herein, the innermost zone 51 shall be referred to herein as the "flame root" and comprises an area including a high proportion of unmixed fuel. The "flame cone" 52 represents the highest temperature area of the flame body 49 where a complete mixture of fuel and oxygen has occurred. The outermost area of the flame body 49, shown at 54, shall be referred to herein as the "flame ghost". The flame ghost 54 generally cannot be seen in the visible spectrum and represents the lowest temperature region associated with the flame body 49. Each of these zones may be evaluated via, for example, by the probe illustrated in FIG. 1, and will thus result in current through gauge 17 and can thereby be used as a means for flame detection.

Figure 2:
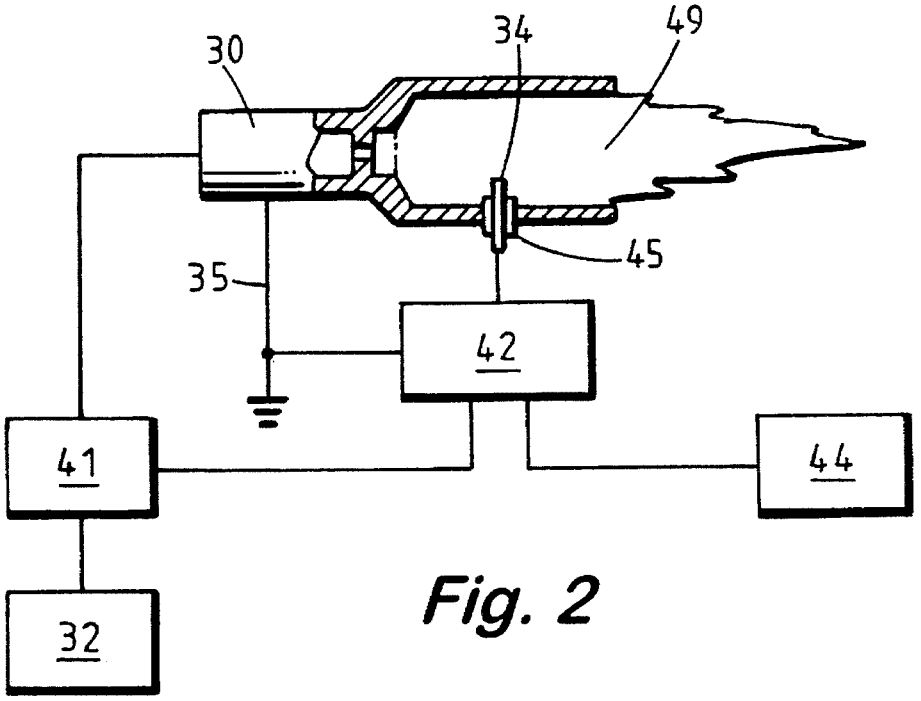
FIG. 2 illustrates a block diagram showing the arrangement of a flame monitoring device in accordance with the present invention.

The present invention and one preferred embodiment thereof may be seen by reference to FIG. 2. FIG. 2 represents a block diagram of the discrete components of a general embodiment of the invention as they might be applied to a burner 30 and a fuel supply 32. As indicated above, burner 30 may adopt any of a variety of configurations and be incorporated in a number of applications including a boiler arrangement, flare stack, jet engine, sulphur recovery units, heater treaters or the like. A sensor means 34 is disposed in or proximate to the flame body 49 and is coupled to an electrical circuit 42, which is further connected through the ground line 35 to burner 30.

By way of FIG. 5, it is envisioned that one or more sensor means 34 may be disposed in any of the three zones 51, 52 or 54 of the flame body 49, though the outer or "ghost" region 54 is desirable due to its attendant lower temperature. While a discrete sensor means or probe 34 is illustrated at FIG. 2, it is further contemplated that sensor means 34 may be integrated into the containment walls of the burner chamber itself. In such a fashion, the life expectancy and the sensitivity of the probe 34 may be enhanced due to the added surface contact with flame 49.

Electrical circuit 42 allows for a voltage to be applied between probe 34 through flame 49 and burner 30 and back through to ground line 35 as described above in relation to the prior art. The flame indication, however, is not determined by the average amount of leakage current through the flame 49, but rather by the modulating frequency of the leakage current through the flame 49. As the gasses ignite, ionization allows them to become conductive. Because the flame is a body of fast moving ionized gasses, minute changes in the rate of ionization creates a resultant mass of modulated impedance. It is this modulated impedance within the moving flame body 49 that generates a useable signal which is continuously modulated in both frequency and amplitude by the apparatus and method of the present of the present invention.

Figure 4:
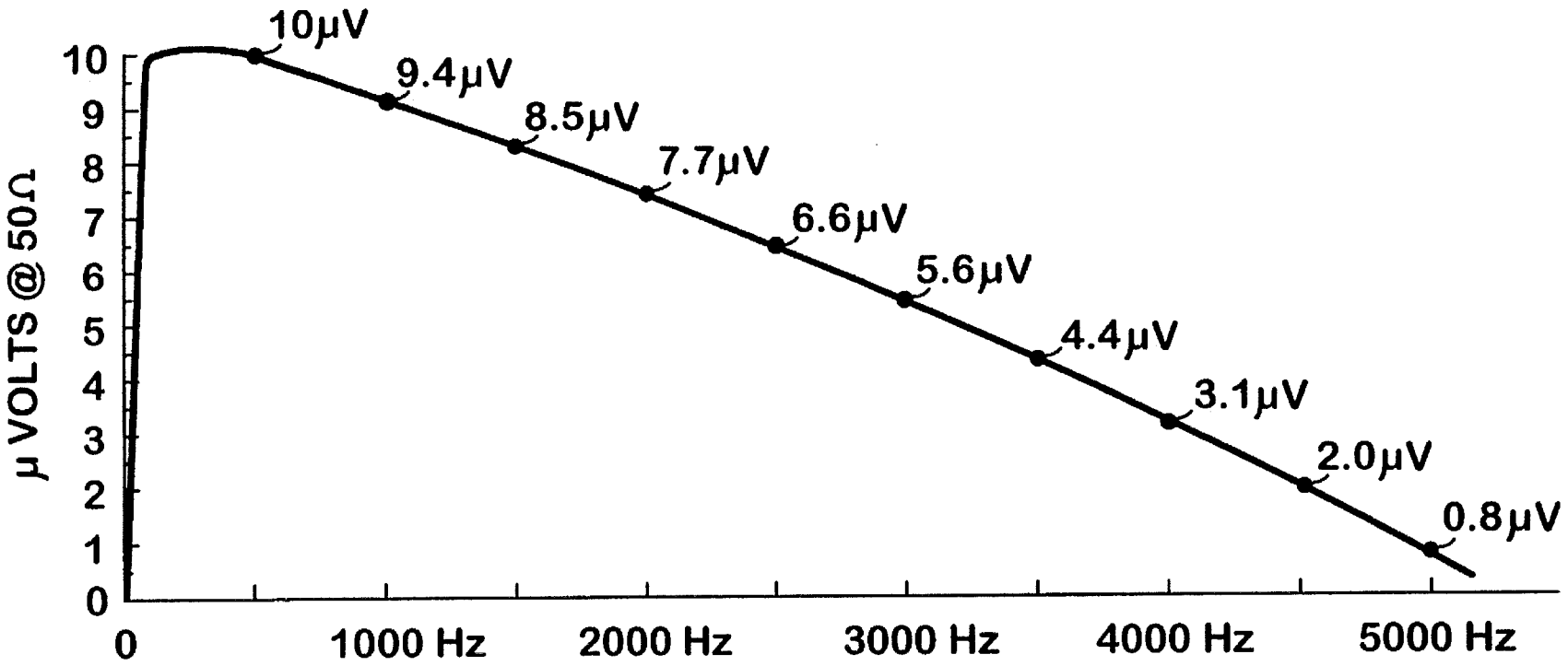
FIG. 4 diagrammatically illustrates the amplitude and frequency range utilized in accordance with the method of the present invention.

By employing a frequency and amplitude selective alternating current amplifier in circuit 42 only those frequencies and amplitudes expected to originate from the modulated impedance are processed. In a general case, such frequencies would be expected to be in the range of 0.00142–5 khz with amplitudes expected to be in the range of 10 nano voltz–10 microvolts as measured by a 50 ohm impedance probe as shown in FIG. 4. The resultant output of circuit 42 is extremely responsive to the loss of flame 49, and, unlike the prior art, can not be misled by a contamination of isolator 45 since such contamination cannot develop the modulating frequencies being processed by circuit 42. Further, electrical circuit 42 controls the fuel supply through fuel solenoid 41. Accordingly, should the flame be extinguished, or, alternately, become too hot, the fuel supply can be automatically modulated. This automatic modulation occurs while simultaneously sending an alarm signal item 44 to operating personnel.

Figure 3:
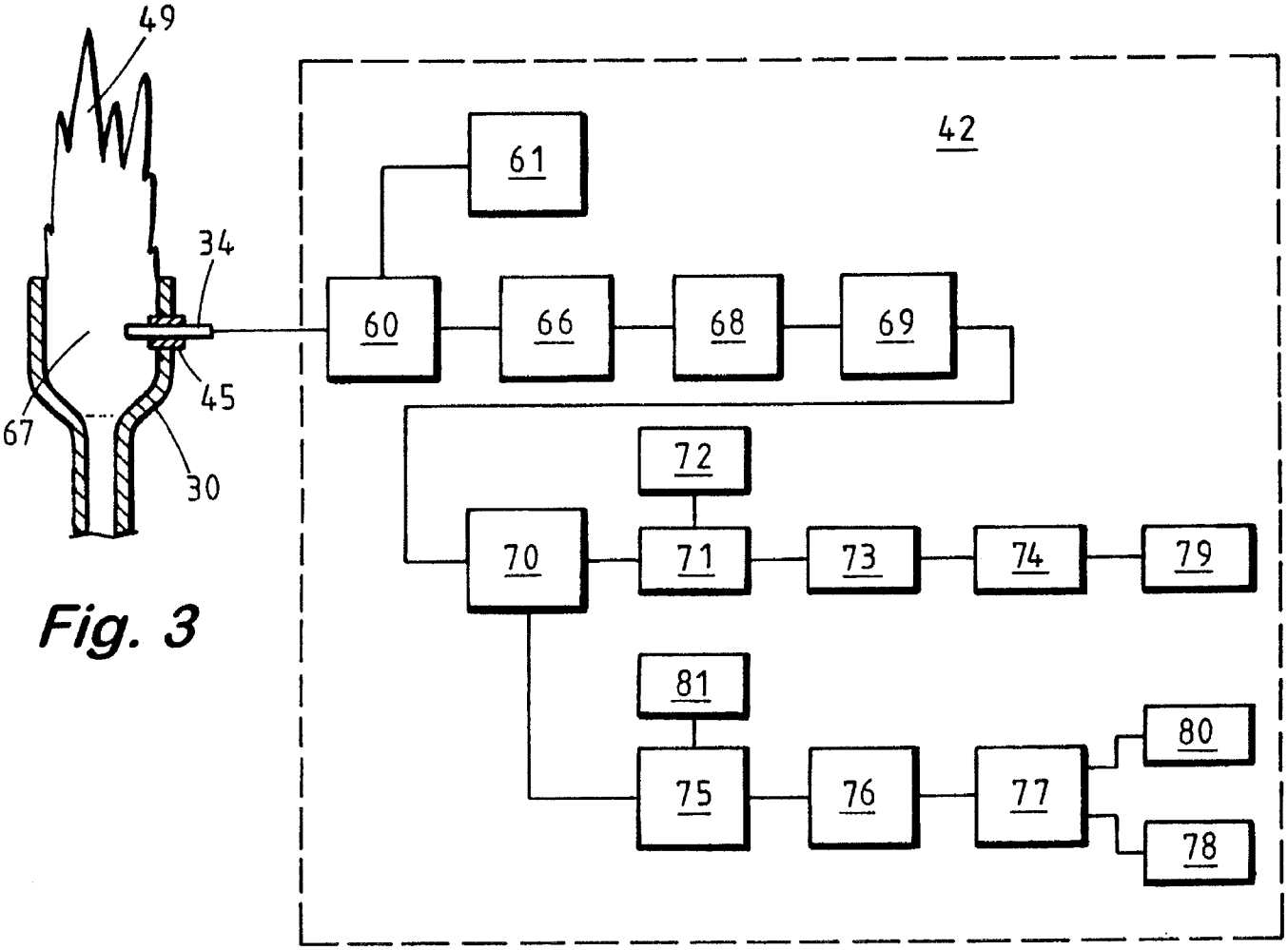
FIG. 3 illustrates a block diagram drawing of one embodiment of the amplifying circuit of the present invention.

FIG. 3 illustrates a detailed electrical schematic of one embodiment of the circuit 42 of the present invention which generally includes a power supply, filtering means, detection means and a frequency comparator. By reference to FIG. 3, a probe current exciter 60 is provided a stable voltage by power supply and filter 61. When the flame body 49 is not providing a connection between probe 34 and pilot body 30, the applied voltage will not result in current flowing through probe 34. Should isolator 45 become dirty or wet, it is expected that some current will begin to flow through probe 34. However, this current will not be processed through the amplifier circuitry due to the direct current isolator 66 which is not adapted to process direct current. Even when the isolator 45 becomes wet or dirty, when a flame 49 is present in chamber 67 the modulating impedance of the flowing ions will develop an alternating current signal which can be processed through direct current isolator 66.

Frequency and amplitude selective amplifier 68 is adapted to amplify and process the appropriate signals to a threshold detector and square wave converter 69. This signal is then fed into a frequency comparator 70 which compares the incoming signal with an established minimum frequency acceptable from the particular flame 49 being monitored. When the input signal exceeds the expected minimum frequency, its output is directed to a flame quality detector 71, which in turn provides an output signal to the flame quality indicator 72, through an output buffer 73 which energizes flame quality relay 74.

Frequency comparator 70 serves to provide an output to the flame presence detector 75 even when the minimum flame quality frequency has not been achieved. Restated, comparator 70 detects that a flame 49 is present, but is not of sufficient quality to operate unattended.

With an output from flame presence detector 75 output buffer 76 maintains the flame presence relay 77 in a condition to continue fueling flame 49 through fuel solenoid control 78. A flame indicator 81 is coupled to detector 75. Should the frequency comparator 70 receive the wrong frequency, or receive no input frequency at all, the flame presence detector 75 and the flame quality detector 71 will not emit a signal. In the event no signal is received, relays 74 and 77 activate a flame quality alarm 79 and the loss of flame alarm 80. Should probe 34 become shorted to the pilot body 30, and a flame 49 is still present in chamber 67, the loss of frequency will send an alarm and will terminate the fuel supply thereto. This type of failure is considered "fail-safe" and is preferred over the previously discussed "non-fail-safe" technology prevalent in the prior art.

The flame frequencies detected as a result of the present inventions are primarily a function of the applied fuel composition and the physical location of the probes within the flame body. Locating the probe adjacent to, or deep within the flame body will result in amplitude and frequency deviations in the available signal. FIG. 4 represents the amplitude and range of frequencies that have been detected using a Hewlett Packard (3585A) Spectrum Analyzer and a Stackmatch "HOT ROD" Flare Pilot with Plasma Resonance Detection or a Stackmatch "DRAM" vessel pilot utilized with fired vessels.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. An apparatus for evaluating the condition of a flame body in a pilot comprising:

sensor means situated in said flame body, where said sensor means is coupled to an electrical circuit;

power means to generate an alternating current electrical signal in said circuit;

means to selectively amplify and measure discrete frequencies and current presented in said electrical signal; and means to compare a final signal derived from said sensor means against known values for the ionization resultant from the combustion of a given fuel/air mixture.

2. The apparatus of claim 1 wherein the sensor means comprises two or more electrically isolated probes disposed in a spaced apart relation in the flame body.

3. The apparatus of claim 2 wherein the probes are situated in the flame and vis-a-vis each other such that they conduct a current in said flame body which is proportional to the conductivity of the ionized particles present in and in contact with said probes.

4. The apparatus of claim 1 wherein said circuit is adapted to solely process changes in conductivity.

5. The apparatus of claim 4 wherein said changes in conductivity produce a signal which exhibits amplitudes and frequencies falling within selected parameters for a selected portion of the flame body.

6. The apparatus of claim 1 further including means to produce an audible or visual alarm in the event frequency values fall outside selected operating parameters.

7. The apparatus of claim 1 wherein said flame is confined within a burner chamber and where said sensor means is incorporated within said chamber.

8. The apparatus of claim 1 wherein said flame is confined within a pilot nozzle and where said sensor means is incorporated within said nozzle.

9. The apparatus of claim 1 wherein the operating frequencies detected in the flame body fall within a range of 0.001 Hz to 20 kHz.

10. The apparatus of claim 1 wherein said sensor means includes a discrete, electrically isolated probe.

11. The apparatus of claim 10 wherein the probe is comprised of a conductive ceramic.

12. The apparatus of claim 10 wherein said probe is positioned in the lowest temperature region of the flame body.

13. The apparatus of claim 1 further including means to modify the flow of fuel to the flame body when said signal falls outside of a selected value.

14. A method for determining the presence of and/or quality of a flame body, comprising:

positioning one or more conductive probes in the flame body such that said probes conduct though said flame body a selected conductivity proportional to the ionized particles present in said body and in contact with said probes which results in an alternating current signal exemplifying discrete frequencies, where further said probes are coupled to an electrical circuit;

generating an alternating current electrical signal in said circuit:

selectively amplifying the discrete frequencies produced in the resultant electrical signal;

collecting and measuring the resultant alternating current signal; and comparing said signal against known values for the ionization resultant from the combustion of a given fuel/air mixture.

15. The method of claim 14 wherein said probes are constructed from a conductive ceramic.

16. The method of claim 14 wherein said probes are positioned in the lowest temperature region of said flame.

17. The method of claim 14 wherein said electrical circuit solely processes changes in conductivity.

18. The method of claim 17 where said changes in conductivity produce a signal which exhibits amplitudes and frequencies falling within selected guidelines for a selected position in the flame body.

19. The method of claim 14 further including the step of modifying the flow of fuel to the flame body when the signal associated with said body falls outside a selected value.

20. The method of claim 14 where in said probes are utilized in a differential mode to electrically improve the signal to noise ratio.

21. A system for differentiating between a "flame" and a "no flame" condition in a flare stack containing a flame in a pilot chamber comprising:

a sensor positioned in said flame and operatively coupled to an electrical circuit such that said sensor is adapted to conduct a current through said flame;

a power source coupled to said circuit and adapted to produce an alternating current electrical signal;

an amplifier adapted to enhance the amplitude of selected frequencies presented in said signal;

means to compare said signal to selected frequencies of the alternating current signal; and means to modify fuel flow to a given flame when the signal associated with said flame falls outside a selected frequency.

22. A method for evaluating the quality of a flame body comprising the steps of:

selectively positioning one or more conductive probes in said flame body where said probes are each coupled to an electrical circuit so as to create a conductive current therebetween;

generating an alternating current electrical signal in said circuit;

amplifying the voltage at each probe where such amplification is amplitude and frequency selective so as to produce a discreet alternating current electrical signal;

measuring the discrete frequencies and current presented in said electrical signal;

comparing said signal against known frequencies for the ionization resultant from the combustion of a given fuel/air mixture.

23. The method of claim 22 where said probes are positioned such that they selectively conduct through said body proportionally to the ionized particles in said body.

24. The method of claim 23 further including the step of modifying the fuel/air mixture to the flame as based on a signal received from the step of comparing said signal against known frequencies.

* * * * *